US010330381B2

(12) United States Patent
Gritti et al.

(10) Patent No.: US 10,330,381 B2
(45) Date of Patent: Jun. 25, 2019

(54) PLANT FOR THE LIQUEFACTION OF NITROGEN USING THE RECOVERY OF COLD ENERGY DERIVING FROM THE EVAPORATION OF LIQUEFIED NATURAL GAS

(71) Applicant: SIAD MACCHINE IMPIANTI S.P.A., Bergamo (IT)

(72) Inventors: Pierluigi Gritti, Albino (IT); Alessandro Bigi, Gorle (IT); Fabio Daniele Masserdotti, Trezzano Rosa (IT)

(73) Assignee: SIAD MACCHINE IMPIANTI S.P.A., Bergamo (IT)

( * ) Notice: Subject to any disclaimer, the term of this patent is extended or adjusted under 35 U.S.C. 154(b) by 0 days.

(21) Appl. No.: 15/549,412

(22) PCT Filed: Mar. 10, 2016

(86) PCT No.: PCT/IB2016/051368
§ 371 (c)(1),
(2) Date: Aug. 8, 2017

(87) PCT Pub. No.: WO2016/147084
PCT Pub. Date: Sep. 22, 2016

(65) Prior Publication Data

US 2018/0038640 A1 Feb. 8, 2018

(30) Foreign Application Priority Data

Mar. 17, 2015 (IT) ..... BG2015A0018

(51) Int. Cl.
*F25J 1/00* (2006.01)
*F25J 1/02* (2006.01)

(52) U.S. Cl.
CPC ..... *F25J 1/0015* (2013.01); *F25J 1/0037* (2013.01); *F25J 1/0082* (2013.01); *F25J 1/0224* (2013.01);
(Continued)

(58) Field of Classification Search
CPC ..... F25J 1/0015; F25J 1/0037; F25J 1/0072; F25J 1/0012; F25J 1/007; F25J 1/0221;
(Continued)

(56) References Cited

U.S. PATENT DOCUMENTS 4,894,076 A * 1/1990 Dobracki ..... F25J 1/0015 62/650
5,139,547 A * 8/1992 Agrawal ..... F17C 9/04 62/616

(Continued)

FOREIGN PATENT DOCUMENTS

WO WO2014102084 7/2014

*Primary Examiner* — Brian M King
(74) *Attorney, Agent, or Firm* — King & Schickli, PLLC

(57) ABSTRACT

Method for the liquefaction of nitrogen using the recovery of cold energy deriving from the evaporation of liquefied natural gas comprising the steps of: sending a flow of nitrogen (100) to be liquefied to a precooler (101); sending a flow (107) of nitrogen gas exiting said precooler (101) to a heat exchanger (108) of the high pressure recirculation compressor; sending a flow (114) of nitrogen exiting said heat exchanger (108) to a high pressure recirculation compressor (115, 117); sending a flow (120) of nitrogen exiting said compressor (115, 117) to a liquefaction heat exchanger (121); sending to said liquefaction heat exchanger (121) a flow (123) of natural gas, countercurrent to the flow (120) exiting said compressor (115, 117); sending a flow (126, 150) of nitrogen exiting said liquefaction heat exchanger (121) to said heat exchanger (108) countercurrent to said flow (107) of nitrogen gas and to said flow (114) of nitrogen; sending a flow (151, 152) of nitrogen exiting said heat
(Continued)

exchanger (108) to said precooler (101) countercurrent to said flow of nitrogen (100) to be liquefied; sending the flow (126, 130) of nitrogen exiting said liquefaction heat exchanger (121) to an expander (131); sending the flow of nitrogen exiting said expander (131) to a medium pressure separator (112) that delivers an exiting flow (132) of nitrogen.

5 Claims, 1 Drawing Sheet

(52) U.S. Cl.
CPC ..... *F25J 1/0292* (2013.01); *F25J 2205/02* (2013.01); *F25J 2210/62* (2013.01)

(58) Field of Classification Search
CPC .... F25J 1/0202; F25J 2235/42; F25J 2240/44; F25J 2245/42
See application file for complete search history.

(56) References Cited

U.S. PATENT DOCUMENTS 5,141,543 A * 8/1992 Agrawal ..... F17C 9/04 62/612
5,584,194 A * 12/1996 Gardner ..... C01B 23/0094 62/615
6,006,545 A * 12/1999 Tranier ..... F25J 1/0015 62/615
2010/0251763 A1* 10/2010 Audun ..... B63B 25/16 62/614

* cited by examiner

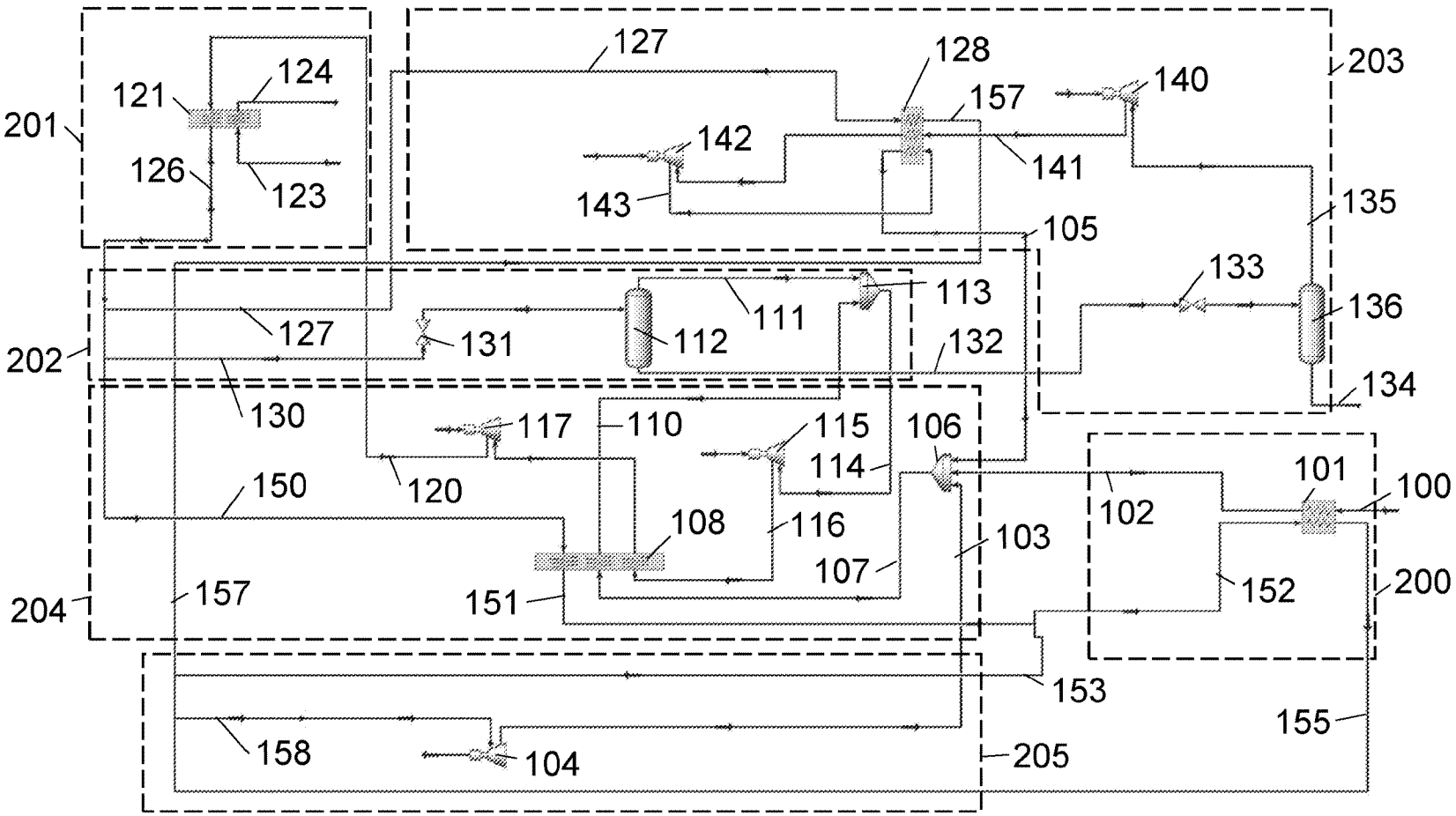
203
135
136
134
100
200
101
155
152
133
140
102
153
141
105
205
103
157
128
113
132
106
107
115
114
116
111
142
112
108
110
127
143
117
104
151
131
120
124
123
127
130
150
158
157
121
126
201
202
204

PLANT FOR THE LIQUEFACTION OF NITROGEN USING THE RECOVERY OF COLD ENERGY DERIVING FROM THE EVAPORATION OF LIQUEFIED NATURAL GAS

This application is the national stage of PCT/IB2016/051368, filed Mar. 10, 2016, which claims priority from Italian Application No. BG2015A000018, filed Mar. 17, 2015.

SUMMARY OF THE INVENTION

The present invention relates to a plant and to a process for the liquefaction of nitrogen using the recovery of cold energy deriving, from the evaporation of liquefied natural gas.

To be able to transport the maximum amount of natural gas, natural gas is transported in liquid form, maintaining it at cryogenic temperatures.

To return to gaseous form, the natural gas must be vaporized and heated, and therefore must transfer its cold energy to another fluid.

The patent EP1469265, by the same applicant, describes a process of this kind.

The object of the present invention is to recover cold energy deriving from the evaporation of liquefied natural gas to use it in the liquefaction of nitrogen.

Another object is to reduce electricity consumption in the liquid nitrogen liquefaction process, exploiting the cold energy obtained from evaporation of liquid natural gas.

A further object is to recover cold energy deriving from the evaporation of liquefied natural gas to use it in the liquefaction of nitrogen that is more advantageous than the processes currently adopted.

In accordance with the present invention, these objects and yet others are achieved by a method for the liquefaction of nitrogen using the recovery of cold energy deriving from the evaporation of liquefied natural gas comprising the steps of: sending a flow of nitrogen to be liquefied to a precooler; sending a flow of nitrogen gas exiting said precooler to a heat exchanger of the high pressure recirculation compressor; sending a flow of nitrogen exiting said heat exchanger to a high pressure recirculation compressor; sending a flow of nitrogen exiting said compressor to a liquefaction heat exchanger; sending to said liquefaction heat exchanger a flow of natural gas, countercurrent to the flow exiting said compressor; sending a flow of nitrogen exiting said liquefaction heat exchanger to said heat exchanger countercurrent to said flow of nitrogen gas and to said flow of nitrogen; sending a flow of nitrogen exiting said heat exchanger to said precooler countercurrent to said flow of nitrogen to be liquefied; sending the flow of nitrogen exiting said liquefaction heat exchanger to an expander; sending the flow of nitrogen exiting said expander to a medium pressure separator that delivers an exiting flow of nitrogen.

These objects are also achieved by a plant for the liquefaction of nitrogen using the recovery of cold energy deriving from the evaporation of liquefied natural gas comprising sending the nitrogen to be liquefied to the following elements positioned in series: a precooler; a heat exchanger of the high pressure recirculation compressor; a high pressure recirculation compressor; a liquefaction heat exchanger that also receives a countercurrent flow of natural gas and supplies a flow of nitrogen; an expander; a medium pressure separator that delivers a flow of nitrogen; and said flow of nitrogen passes through said heat exchanger and said precooler.

Further features of the invention are described in the dependent claims.

The advantages of this solution with respect to solutions known in the art are various.

The present plant has a specific consumption of less than a 0.1 kW/Nm3 of LIN for a liquefier with a capacity of 400 TPD, and therefore a reduction of the specific consumption for liquefaction of nitrogen of around 80% is obtained with respect to the classic liquefaction cycle that does not use the recovery of cold energy from LNG, which typically has a specific consumption of 0.52 kW/Nm3 LIN.

A considerable reduction in electricity consumption is also obtained with respect to the aforesaid patent EP1469265, in fact, the present solution uses one less compressor, as the nitrogen that is liquefied (processed by the high pressure recirculation compressor) acts both as coolant and as liquefying product. As a result of this, the high pressure recirculator of the previous patent is integrated in the compressor that takes the nitrogen to the liquefaction pressure.

Moreover, this synergy leaves intact the condition that the liquefied natural gas is never used directly to cool the gas processed by the compressors.

BRIEF DESCRIPTION OF THE DRAWING FIGURES

The features and the advantages of the present invention will be apparent from the following detailed description of a practical embodiment thereof, illustrated by way of non-limiting example in the accompanying drawing, wherein:

FIG. 1 shows a plant for the liquefaction of nitrogen using the recovery of cold energy deriving from the evaporation of liquefied natural gas in accordance with the present invention.

DETAILED DESCRIPTION OF THE INVENTION

With reference to the accompanying FIGURE a plant for the liquefaction of nitrogen using the recovery of cold energy deriving from the evaporation of liquefied natural gas in accordance with the present invention receives the gaseous nitrogen to be liquefied at a pressure of 10 bar and at the ambient temperature of 15° C., while the natural gas is at the temperature of −156° C.

The flow of nitrogen 100 to be liquefied is supplied to a precooler 101.

The flow 102 of precooled nitrogen is combined with the flow 103 of recirculating gas coming from the turbine 104 and with the flow 105 of cold gas recovered from the low pressure recirculation that are combined in the cold nitrogen collector 106 at a pressure of 10 bar and at a temperature of −110° C.

The flow 107 exiting the collector 106 is sent to the heat exchanger 108 of the high pressure recirculation compressor to be further cooled to −145° C.

The flow 110 exiting the heat exchanger 108 is combined, in the collector 113, with the flow 111 of flash gas (−165° C.) coming from the medium pressure separator 112.

The flow 114 exiting the collector 113 is compressed in the first stage 115 of the high pressure recirculation compressor.

The flow 116 exiting the first stage 115 is cooled in the heat exchanger 108 and is sent to the second stage 117 of the high pressure recirculation compressor, removing the compression heat, so that suction of the machine takes place at the lowest temperature possible. (−150° C.). In this way, the electricity consumption is reduced considerably as the volumetric flow rate to be compressed is lower.

The flow 120 of nitrogen exiting the second stage 117 of the high pressure recirculation compressor is at a pressure of around 40 bar so as to liquefy the nitrogen (−154° C.) as a result of the natural gas available (−156° C.).

The flow 120 exiting the second stage 117 is sent to the liquefaction heat exchanger 121.

The flow 123 of natural gas enters, countercurrent with respect to the nitrogen, the heat exchanger 121, from which the flow 124 exits. The natural gas gasifies (up to −125° C.) and the nitrogen liquefies at a temperature a few degrees above the temperature of the natural gas entering.

The flow 126 of liquid nitrogen produced is divided into two flows.

A first flow 127 (around 10% of the total) is sent to the heat exchanger 128 of the low pressure recirculation compressor to remove the heat of compression downstream of each compression stage.

The nitrogen, still cold, see the flow 157, is immediately recirculated to the turbine 104.

The second flow 129 (the remaining 90%) is divided again (approximately in half) into two flows 130 and 150.

One flow 130 is further cooled by a reduction in pressure, by an expander 131, to the value of the suction pressure of the high pressure recirculation compressor (around 10 bar), and reaches the medium pressure separator 112.

The liquid phase 132 is separated from the vapour phase 111 in the medium pressure separator 112, recovering the cold flash 111 (around 25% of the flow rate that expands at −165° C.) directly at the suction side of the first stage (−150° C.) of the high pressure recirculation compressor 115.

The flow 132 of liquid nitrogen at equilibrium pressure at 10 bar is further cooled by a reduction in pressure, by an expander 133, to the storage pressure value (the pressure downstream of the expander is ambient pressure plus of the tank loading head, causing gasification of 25% of the flow 132 at equilibrium temperature of −193° C.).

The flow exiting the expander 133 is sent to a low pressure separator 136 where the liquid phase 134 is separated from the vapour phase 135.

The liquid phase 134 is sent to storage, while the vapour phase 135 is sent to the first stage 140 of the low pressure recirculation compressor. The flow 141 exiting the first stage 140 is cooled in the heat exchanger 128 and sent to the second stage 142 of the low pressure recirculation compressor.

The low pressure and the high pressure recirculation compressors have two stages and comprise the intermediate heat exchangers, respectively 128 and 108. The heat exchanger 128 should be considered optional; in this way the electricity consumption of the low pressure recirculation compressor can be further reduced, as the volumetric flow rate to be compressed is lower.

The flow 143 exiting the second stage 142 of the low pressure recirculation compressor is once again sent to the heat exchanger 128. The flow 105 exiting the heat exchanger 128 is sent to the collector 106.

The other flow 150, coming from the second flow 129 is sent to the heat exchanger 108 of the high pressure recirculation compressor.

The flow 151 exiting the heat exchanger 108, is divided into the two flows 152 and 153.

The flow 152 is sent to the precooler 101, the flow 155 exiting from which is combined with the flow 153 and with the flow 157 exiting the heat exchanger 128, related to the flow 127.

The resulting flow 158 is further cooled by means of a reduction in pressure, by a turbine 104, which expands the entering flow to the pressure of the precooled gas to be liquefied (10 bar and −110° C.).

The plant has been divided into blocks to facilitate understanding thereof.

The block 200 receives the nitrogen to be liquefied, and performs precooling.

The block 201 receives the natural gas and performs liquefaction of the nitrogen.

The block 202 is used for the production of liquid nitrogen.

The block 203 is used for subcooling.

The block 204 is used for compression and for cold energy to (temperature) recovery.

The block 205 is used for the work (pressure) recovery.

The block 203 is optional, as, if storage of liquid nitrogen at the same pressure as the flow 100 (entering nitrogen gas) is required, the low pressure separator 136, the low pressure recirculation is compressor 140 and 142, and the heat exchanger 128 are not installed, as subcooling is not required.

When entering the block 203 the liquid nitrogen is at the pressure as the flow 100 (entering nitrogen gas) and therefore the flow 132 is sent directly to storage.

Although maintaining the block 203 in the plant, the heat exchanger 128 of the low pressure recirculation compressor is also optional: this heat exchanger 128 is only installed if the low pressure recirculation compressor 140, 142 has a capacity large enough to offset the installation cost of the heat exchanger 128 with the energy gain deriving from intercooling of the compression stages.

The block 200 is also optional, as if the nitrogen is not precooled we lose the coldest refrigeration duty at the inlet of the high pressure recirculation heat exchanger 108 with a consequent increase in the specific consumption due to the increase in recirculating flow rate that the heat exchanger must cool and the decrease in the efficiency of the turbine 104, as the volumetric flow rate at the suction side of the turbine is lower.

The nitrogen gas produced by the medium pressure separator 112 is reintegrated directly on the suction side of the first stage of the high pressure recirculation compressor 115.

Moreover, there is the option of recovering this gas directly in the collector 106 (together with the precooled nitrogen 102 and with recovery 105 of the nitrogen from the low pressure recirculation compressor 140, 142) before the nitrogen gas enters the high pressure recirculation heat exchanger 128. Any recovery in the collector 106 (and not on the suction side of the machine) only affects the efficiency of the cycle, due to a slight increase in the specific consumption of the high pressure recirculation compressor.

The axes of the machines 104, 117, 115, 140, 142, all or partially, can be mechanically connectable so as to be able to further reduce electricity consumptions. In particular, for small plants they can all be separate, whereas in larger plants it is advantageous to connect them.

In accordance with the present invention, it has been attempted to use large amounts of natural gas available in the regasification area to maintain the compression temperature at the lowest possible point to allow the compression of large amounts of gaseous nitrogen with low energy consumption.

Moreover, using an expander 104, it is possible to expand the liquid nitrogen gasified by the heat exchanger 108 and heated 152, 155 in the expander 104 to produce a large amount of mechanical or electrical energy, which can be used by the compressor 117 and/or 115 to compress the recirculating nitrogen 107 again.

The function of the precooler 101 is that of lowering the operating temperature (hot side) of the heat exchanger 108 to cryogenic temperatures to allow improved specific power consumption of the high pressure recirculation compressor 115/117.

The flow 114 of nitrogen exiting the heat exchanger 108 is sent to the high pressure recirculation compressor 115, 117, at the lowest possible temperature using liquid nitrogen coming from the heat exchanger 121, further improving energy efficiency.

The flow 126 exiting the liquefaction heat exchanger 121 is liquid nitrogen to be able to cool the elements downstream to the lowest possible temperature. In this way, the use of liquid nitrogen, therefore at a temperature below −155° C., allows a further reduction in the power consumption of the plant.

The flow 151, 152 of nitrogen exiting the heat exchanger 108 is sent to the precooler 101 countercurrent to the flow of nitrogen 100 to be liquefied, to heat as much as possible the nitrogen gasified in 108 to be expanded in the turbine 104 with higher mechanical/electrical energy recovery so as to reduce the energy consumption of the plant.

The use of an expander 131 to produce liquid nitrogen 132, and the separator 112 that separates the nitrogen coming from the expander 131 allows a flow of cold nitrogen gas 111 to be obtained, which is not sent to a heat exchanger such as 128, but directly to the suction side of the high pressure recirculation compressor 115/117 so as to lower the compression temperature for improved specific power consumption.

The use of a recirculation compressor 115/117 not only processes the nitrogen to be liquefied 132/134, as end product deriving from the flow of nitrogen 100 to be liquefied, but also treats a much higher flow rate 107/110/114/120 so as to collect more cold energy from the liquid methane 123 so as to transfer it via the liquid nitrogen 150 to the heat exchanger 128 to obtain improved interstage cooling of the compressor 115/117 (in energy efficiency). This new arrangement of the compressor 115/117 with respect to the heat exchangers 128 and 121 makes it possible to obtain a specific consumption of the production of liquid nitrogen <<0.1 kW/Nm3, electricity consumption that is otherwise not possible.

In alternative embodiments of the present plant, perhaps with lower performance, but equally functional, the following can be implemented.

The nitrogen to be liquefied is sent to the following elements positioned in series: the heat exchanger 108 of the high pressure recirculation compressor; the high pressure recirculation compressor 115, 117; the liquefaction heat exchanger 121 that also receives the countercurrent flow 123 of natural gas; the expander 131; the medium pressure separator 112 that delivers the flow 132 of nitrogen.

In particular, the compressor 115, 117 comprises in series the first stage 115 of the high pressure recirculation compressor; the heat exchanger 108 and the second stage 117 of the high pressure recirculation compressor.

The precooler 101 can also be added at the inlet of the plant described above, before sending the flow 102 to the collector 106.

The expander 133 where the flow is further cooled by a reduction in pressure and the other low pressure separator 136 where the liquid phase 134 is separated from the vapour phase 135 can also be added at the outlet.

The block 205 can therefore be added.

The block 203 can also be added.

The plants thus conceived are susceptible to numerous modifications and variants known to the those skilled in the art after the present description has come to their knowledge, all falling within the scope of the present inventive concept: moreover, all the elements used can be replaced by technically equivalent elements.

The invention claimed is:

1. A method for the liquefaction of nitrogen using the recovery of cold energy deriving from the evaporation of liquefied natural gas comprising the steps of: sending a flow of nitrogen (100) to be liquefied to a precooler (101); a flow (102) exiting from the precooler (101) is sent to a collector (106) that delivers the flow (107) of nitrogen gas; sending the flow (107) of nitrogen gas exiting the precooler (101) to a first heat exchanger (108) of a first pressure recirculation compressor; sending the flow (114) of nitrogen exiting the first heat exchanger (108) to a first stage (115) of the first pressure recirculation compressor; sending a compressed flow (116) exiting the first stage (115) to the first heat exchanger (108) and sending the compressed flow exiting the first heat exchanger (108) to a second stage (117) of the first pressure recirculation compressor at the lowest temperature possible of −150° C.; sending the flow (120) of nitrogen exiting the first pressure recirculation compressor to a second heat exchanger (121); sending to the second heat exchanger (121) a flow (123) of liquified natural gas, countercurrent to the flow (120) of nitrogen exiting the first pressure recirculation compressor (115); sending a first portion (150) of the flow (126) of liquid nitrogen exiting the second heat exchanger (121) first to the first heat exchanger (108) countercurrent to the flow (107) of nitrogen gas and to the compressed flow (116) of nitrogen; and then sending a second portion of the flow (152) of the flow (126) of liquid nitrogen to the precooler (101) countercurrent to the flow of nitrogen (100) to be liquefied; sending the second portion of the flow (155) exiting from the precooler (101) to a turbine (104); sending the flow (103) exiting from the turbine (104) to the collector (106); sending a third portion (130) of the flow (126) of liquid nitrogen exiting the second heat exchanger (121) to an expander (131); and sending the flow of nitrogen exiting the expander (131) to a second pressure separator (112) that delivers an exiting flow (132) of liquified nitrogen.

2. A method for the liquefaction of nitrogen in accordance with claim 1, characterized in that the method also comprises the steps of: sending the flow (132) of nitrogen exiting the second pressure separator (112) to the expander (133) where it is further cooled by a reduction in pressure; sending the flow of nitrogen exiting the expander (133) to a third pressure separator (136) where a liquid phase (134) is separated from a vapour phase (135).

3. A method for the liquefaction of nitrogen in accordance with claim 1, characterized in that the method also comprises the steps of: sending the first portion of the flow (126, 127) of liquid nitrogen exiting the second liquefaction heat exchanger (121) to a heat exchanger (128) of a third pressure recirculation compressor; sending the flow (157) exiting the heat exchanger of the third pressure recirculation compressor (128) to the turbine (104); sending a flow (135) of nitrogen in vapour phase exiting a third pressure separator (136) to a first stage (140) of the third pressure recirculation compressor; the flow (141) exiting the first stage (140) is sent to a second stage (142) of the third pressure recirculation compressor (128); the flow (143) exiting the second stage (142) is sent to the collector (106).

4. A plant for the liquefaction of nitrogen using the recovery of cold energy deriving from the evaporation of liquefied natural gas comprising sending the nitrogen to be liquefied to the following elements positioned in series: a precooler (101); a collector (106); a first heat exchanger (108) of a high pressure recirculation compressor that receives a flow (150) of liquid nitrogen in order to cool down the flow (107) of nitrogen gas exiting the precooler (101) and the flow (116) exiting from a first stage (115) of the first pressure recirculation compressor; the first heat exchanger (108) and a second stage (117) of the first pressure recirculation compressor; a second heat exchanger (121) that also receives a countercurrent flow (123) of liquified natural gas and supplies a flow (126) of nitrogen; an expander (131); a second pressure separator (112) that delivers a flow (132) of liquified nitrogen; and a portion of the flow (126) delivered by the second pressure separator of nitrogen passes through the first heat exchanger (108) and the precooler (101); and a turbine (104) that receives the flow (155) exiting from the precooler (101) and is sent to the collector (106).

5. A plant for the liquefaction of nitrogen in accordance with claim 4, characterized by adding at an outlet an expander (133) where the flow of nitrogen is further cooled by a reduction in pressure and a third pressure separator (136) where a liquid phase (134) is separated from a vapour phase (135).

* * * * *